US008739896B2

(12) United States Patent
Andersson et al.

(10) Patent No.: US 8,739,896 B2
(45) Date of Patent: Jun. 3, 2014

(54) PERCUSSION DEVICE

(75) Inventors: Kurt Andersson, Tyresö (SE); Jörgen Rodert, Saltsjö-Boo (SE)

(73) Assignee: Atlas Copco Rock Drills AB, Orebro (SE)

( * ) Notice: Subject to any disclaimer, the term of this patent is extended or adjusted under 35 U.S.C. 154(b) by 812 days.

(21) Appl. No.: 11/663,016

(22) PCT Filed: Sep. 28, 2005

(86) PCT No.: PCT/SE2005/001425

§ 371 (c)(1),
(2), (4) Date: Mar. 15, 2007

(87) PCT Pub. No.: WO2006/041376

PCT Pub. Date: Apr. 20, 2006

(65) Prior Publication Data

US 2007/0277991 A1 Dec. 6, 2007

(30) Foreign Application Priority Data

Oct. 14, 2004 (SE) ..... 0402482

(51) Int. Cl.
*B25D 9/14* (2006.01)

(52) U.S. Cl.
CPC ..... *B25D 9/14* (2013.01)
USPC ..... 173/206; 173/135; 173/138

(58) Field of Classification Search
CPC ..... B25D 9/14
USPC ..... 173/14, 135–138, 206; 91/300, 321; 251/318
See application file for complete search history.

(56) References Cited

U.S. PATENT DOCUMENTS

| | | | | | |
|---|---|---|---|---|---|
| 3,322,038 | A | | 5/1967 | Dobson | |
| 3,774,502 | A | | 11/1973 | Arndt | |
| 3,965,799 | A | | 6/1976 | Juvonen et al. | |
| 4,582,145 | A | * | 4/1986 | Salmi et al. | 173/64 |
| 4,899,836 | A | | 2/1990 | Venot | |
| 5,056,606 | A | * | 10/1991 | Barthomeuf | 173/13 |
| 5,372,196 | A | * | 12/1994 | Andersson | 175/296 |
| 5,392,865 | A | * | 2/1995 | Piras | 173/17 |
| 5,890,548 | A | * | 4/1999 | Juvonen | 173/208 |
| 5,979,291 | A | | 11/1999 | Juvonen | |

(Continued)

FOREIGN PATENT DOCUMENTS

| | | | |
|---|---|---|---|
| JP | 9202105-4 | * | 7/1992 |
| SE | EP0578623 A2 | * | 1/1994 |
| WO | 2004/073931 | | 9/2004 |

*Primary Examiner* — Michelle Lopez
(74) *Attorney, Agent, or Firm* — Mark P. Stone

(57) ABSTRACT

A percussion device has a machine housing (1), a forwards and backwards movable percussion piston (2) in the machine housing, and a reciprocatingly movable valve body (6) in the machine housing. The percussion piston has a first (4) and a second (5) driving surface subjected to pressure to drive the percussion piston (2) forwards and backwards. The valve body (6) has a first end surface (12) and a second end surface (13) for driving the valve body in first and second directions by applied pressure. The valve body (6) is arranged over a channel (7) in the machine housing, to connect at least the second (5) driving surface alternately to a pressure source (8) or to low pressure (9), and the second end surface (13) is alternately connectable by the percussion piston (2) to the pressure source (8) or, over a valve device (11) for creating a counter-pressure, to the low pressure (8).

5 Claims, 1 Drawing Sheet

(56) References Cited

U.S. PATENT DOCUMENTS 6,371,222 B1 * 4/2002 Andersson et al. ..... 175/135
6,877,569 B2 * 4/2005 Koskimaki ..... 173/1
7,410,010 B2 * 8/2008 Henriksson et al. ..... 173/208
2007/0267223 A1 * 11/2007 Andersson et al. ..... 175/296
2009/0025947 A1 * 1/2009 Peltonen ..... 173/8

* cited by examiner

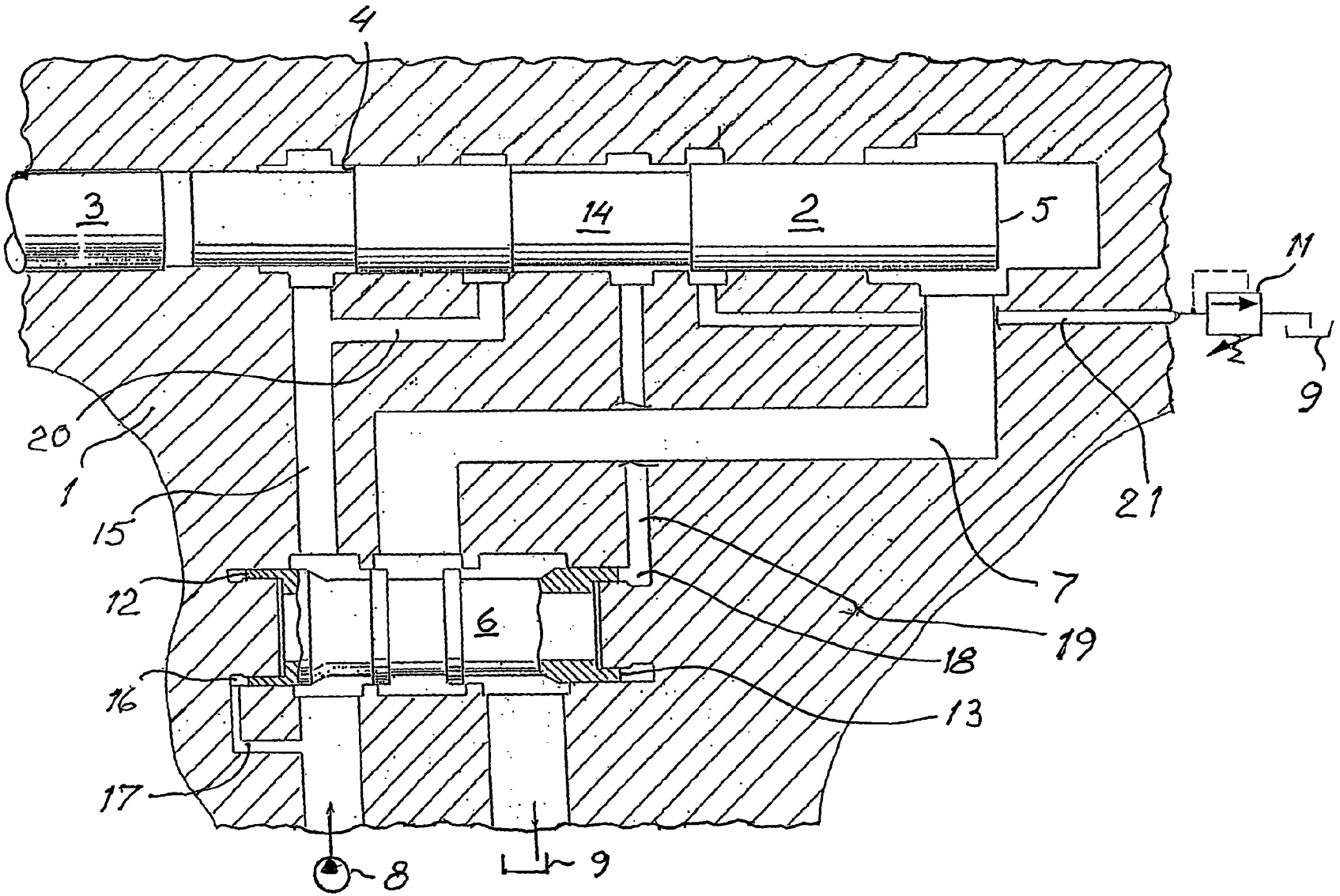
11
9
21
5
2
14
3
4
7
19
18
13
6
9
8
20
1
15
12
16
17

PERCUSSION DEVICE

BACKGROUND OF THE INVENTION

The present invention relates to a percussion device of the type that is included in rock drilling machines.

In a previously known percussion device of this kind, see U.S. Pat. No. 5,372,196, it has been proved to be difficult to obtain sufficiently fast valve change-over in order to work at the high frequencies that are desired in modern high performance drilling. It is the primary object of the present invention to provide an improved percussion device increasing the speed of the valve change-over.

SUMMARY OF THE INVENTION

The present invention as disclosed herein aims at creating a percussion device with fast valve change over which is suitable for high performance drilling. In the known devices, an essential explanation why the valve change over is not fast enough for high performance drilling is that an important portion of the liquid which is located in front of the valve body at the return of the valve body continues because of inertia. Because of this, a refill must take place in order to build up the pressure before the valve body starts to move in the opposite direction. The objective of the present invention, which is to provide a faster valve change-over time, is accomplished by crating a counter-pressure to decrease the change-over time of a slide valve which controls the pressurization of the driving surfaces of an impact piston.

BRIEF DESCRIPTION OF THE DRAWING

An embodiment of the invention is described below with reference to the annexed drawing which schematically shows a section through a percussion device according to the invention.

DESCRIPTION OF THE BEST MODES FOR CARRYING OUT THE INVENTION

The percussion device shown on the drawing includes a machine housing 1, wherein a percussion piston 2 is reciprocatingly movable in order to subject a tool 3 to impacts. The tool is as usual provided with a here not shown drill bit. The percussion piston is provided with a first driving surface 4 which in the shown example is continuously pressurized by a pressure source 8 over a channel 15. The percussion piston is further provided with a second driving surface 5 which in the shown example is comprised of the rear surface of the percussion piston. The driving surface 5 is alternately connected to the pressure source 8 or to the low pressure of the tank 9 over channel 7 and a valve body 6 which is movable forwards and backwards in the machine housing. As an alternative the valve body could connect both driving surfaces alternately to the pressure source or low pressure. In the shown example, the pressurizing of the first driving surface 4 drives the percussion piston to the right in the FIGURE. Since the area of the second driving surface 5 is essentially larger than the area of the first driving surface 4, pressurizing of the driving surface 5 results in that the percussion piston is driven to the left in the FIGURE, against the effect of the pressure on the driving surface 4. The valve body 6 is constructed as a tubular slide with a first end surface 12 which is subjected for the pressure in a first chamber 16. The chamber 16 is over the channel 17 connected to the pressure source 8. The valve body 6 is further provided with a second end surface 13 which is subjected to the pressure in a second chamber 18. The chamber 18 is over the channel 19 connected to the cylinder bore of the percussion piston 2. The pressure in the channel 19 is controlled by the percussion piston 2 which is provided with a portion 14 having a reduced diameter. When the percussion piston 2 is positioned somewhat to the left of the position in the FIGURE, the channel 19 is in connection with the pressure source 8 over the channels 15 and 20. The valve body 6 is then pressed to the left in the FIGURE. When the percussion piston 2 reaches the position shown in the FIGURE, the connection of the channel 19 with the pressure source 8 has been broken and a connection with the channel 21 started to open. In the channel 21 there is positioned a constant pressure valve 11. Its function is to give a constant fall off pressure independent of the flow through the valve. It is thus a valve device for creating a counter-pressure. Hereby the amount of liquid leaving the channel 19 when the valve body 6 changes direction in its right position in the FIGURE is essentially reduced, whereby the change-over goes essentially faster.

The invention claimed is:

1. Percussion device for rock drilling machines including a machine housing, a forwards and backwards movable percussion piston in a cylinder bore in the machine housing, and a reciprocatingly movable valve body in the machine housing, said percussion piston being adapted to subject a tool to impacts, and said percussion piston including a first and a second percussion piston driving surface intended to be subjected to pressure in order to drive the percussion piston forwards and backwards, said valve body including a first valve body driving surface and a second valve body driving surface, wherein pressurizing the first valve body driving surface tends to drive the valve body in a first direction and pressurizing the second valve body driving surface tends to drive the valve body in a second direction, said valve body being arranged, over a first channel arranged in the machine housing, to connect at least the second of the percussion piston driving surfaces alternately to a pressure source or to low pressure, wherein the second valve body driving surface is connected, dependent on the position of the percussion piston, either to the pressure source or, over a valve device for creating a counter pressure, to the low pressure in a tank for reducing the time necessary for the valve body to change direction of movement between said first and second directions, said valve device being positioned in a second channel connecting the cylinder bore with the tank.

2. Percussion device according to claim 1, wherein the first driving surface is continuously connected to the pressure source.

3. Percussion device according to claim 1, wherein the first valve body driving surface is continuously connected to the pressure source.

4. Percussion device according to claim 2, wherein the first valve body driving surface is continuously connected to the pressure source.

5. Percussion device for rock drilling machines including a machine housing, a forwards and backwards movable percussion piston in a cylinder bore in the machine housing, and a reciprocatingly movable valve body in the machine housing, said percussion piston being adapted to subject a tool to impacts, and said percussion piston including a first and a second percussion piston driving surface intended to be subjected to pressure in order to drive the percussion piston forwards and backwards, said valve body including a first valve body driving surface and a second valve body driving surface, wherein pressurizing the first valve body driving surface tends to drive the valve body in a first direction and pressurizing the second valve body driving surface tends to drive the valve body in a second direction, said valve body being arranged, over a first channel arranged in the machine housing, to connect at least the second of the percussion piston driving surfaces alternately to a pressure source or to low pressure, wherein the second valve body driving surface is connected, dependent on the position of the percussion piston, either to the pressure source or, over a valve device for creating a counter pressure, to the low pressure in a tank for reducing the time necessary for the valve body to change direction of movement between said first and second directions, said valve device being positioned in a second channel connecting a portion of the cylinder bore in which portion the percussion piston moves during operation of the percussion device with the tank.

* * * * *